US007234616B2

(12) United States Patent
Thom et al.

(10) Patent No.: US 7,234,616 B2
(45) Date of Patent: Jun. 26, 2007

(54) FRICTION ARRANGEMENT FOR HOSIERY DONNING AID

(75) Inventors: Paul Thom, Butler, NJ (US); Francis Gomes, Jersey City, NJ (US); Kathleen L. O'Neill, Bloomingdale, NJ (US); David Landsberger, Caldwell, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 54 days.

(21) Appl. No.: 11/024,207

(22) Filed: Dec. 27, 2004

(65) Prior Publication Data

US 2006/0138181 A1 Jun. 29, 2006

(51) Int. Cl.
*A47G 25/90* (2006.01)

(52) U.S. Cl. ..... 223/112; 223/111; 223/1

(58) Field of Classification Search ..... 223/111–113, 223/118–119, 1
See application file for complete search history.

(56) References Cited

U.S. PATENT DOCUMENTS 3,310,209 A 3/1967 Clauss
4,637,533 A 1/1987 Black
4,789,087 A * 12/1988 Doorenbos ..... 223/111
4,943,097 A 7/1990 Sanger
5,626,269 A * 5/1997 Duarte ..... 223/112
5,706,988 A * 1/1998 Moore ..... 223/111
5,799,844 A 9/1998 James
5,826,761 A 10/1998 Basaj
5,894,970 A 4/1999 Belkin et al.
5,909,831 A 6/1999 Griffin
5,974,701 A 11/1999 Busch
6,032,839 A 3/2000 Joosten et al.
6,056,171 A 5/2000 Santamaria

FOREIGN PATENT DOCUMENTS

FR 2814930 4/2002

* cited by examiner

*Primary Examiner*—Gary Welch
*Assistant Examiner*—Andrew W. Sutton
(74) *Attorney, Agent, or Firm*—Lawrence G. Fridman

(57) ABSTRACT

A hosiery donning aid apparatus comprises a body formed as a channel having interior and exterior surfaces and two outer edges extending along a longitudinal axis of the body. A frictional arrangement is provided consisting of a multiplicity of spaced from each other frictional ribs extending outwardly from the exterior surface in such a manner that a substantial gap separates each end of each frictional rib from the respective outer edges.

16 Claims, 5 Drawing Sheets

FRICTION ARRANGEMENT FOR HOSIERY DONNING AID

BACKGROUND OF THE INVENTION

This invention relates to devices adapted to provide assistance to persons who are unable to don hosiery without help. More specifically, it relates to a hosiery donning aid apparatus having improved engagement with the hosiery item.

It is well known that people with various physical conditions have great difficulty dressing themselves. This often creates obstacles for them to live independently. Many people who suffer from back, hip or knee disorders find it difficult, if not impossible, to put on hosiery without assistance. To put on or don a foot covering such as a sock or stocking is frequently difficult due to the various combinations of leg and arm limitations that affect this activity. Examples of limited physical conditions include diminished range of motion in the back or knee, or leg strength, such that the foot cannot easily be brought into reach. Another example is limited hand strength or limited range of motion in the fingers of both hands. Such conditions make it difficult to widen the opening of the foot covering while simultaneously inserting the toes and heel of one foot into the opening. The difficulty may be pronounced for foot coverings such as a support stocking intended to fit snuggly on the foot.

Several kinds of devices have been proposed by the prior art and which are designed to alleviate the above discussed problems. These devices are adapted to provide assistance of such nature that a person who is unable to don hosiery without help need not require the services of another person.

Some of such devices are more effective than others, but many of them have certain drawbacks such as maintaining an article of hosiery on the device in certain position during and following insertion of a person's foot into such article. These problems encountered with previously known devices relates to the difficulty of immobilizing the device during application of the hosiery to the person's foot and leg.

It is also well known that physical disability makes it difficult to properly coordinate positioning of the foot within the hosiery item in such a manner that the toes and heel of a foot are properly situated within the respective portions of a stocking. One of the major functions of the prior art devices is to assist in this important task. However, after insertion of the available donning aid into the interior of the stocking it is quite difficult to coordinate and retain the required position of the aid within the interior of the stocking. In order to achieve this important task, a proper engagement has to be assured between the stocking aid and the interior of the hosiery items. The known devices for accomplishing these functions are often complex, expensive, and require a significant amount of hand strength for accomplishing this task.

Thus, there has been a long-felt unsolved need to provide a hosiery donning aid capable of retaining its position after being inserted within the interior of the stocking. There has also been a need for such devices which are simple, effective, easy to use and inexpensive to manufacture.

BRIEF SUMMARY OF THE INVENTION

One aspect of the invention provides a hosiery donning aid apparatus comprising a body having inner and outer surfaces and being formed as a channel having at least two side walls terminating at respective outer edges. A frictional arrangement is provided on the body comprising a multiplicity of spaced from each other frictional ribs extending outwardly from the outer surface in such a manner that a substantial gap separates each end of each frictional rib from the respective outer edges.

As to another aspect of the invention, an apparatus is provided wherein the elongated channel is formed having C-shaped cross-section, in use the inner surface of the C-shaped channel is adapted to guide the foot of a wearer, and the outer surface including the frictional arrangement is adapted to engage an inner surface of a hosiery item, so as to enhance engagement therebetween. The engagement between the hosiery item and the donning aid apparatus is also enhanced in view of the compression forces generated by the hosiery item itself and expansion pressure resulted from the resilience of its material.

As to another aspect of the invention, at least one cut-out portion is formed within the body, to extend inwardly from the distal end and form at least two prongs. The at least one cut-out portion is defined by a pair of spaced longitudinal edges interconnected by a curved portion. The frictional ribs are disposed on the outer surface of the prongs so as to be separated into a plurality of frictional segments by the at least one cut-out portion.

As to yet another aspect of the invention, the at least one cut-out portion comprises at least two cut out portions extending inwardly from the distal end of the body, thus forming at least three prongs. The plurality of frictional segments is disposed on the outer surface of the prongs, so as to be spaced from the respective outer edges of the channel and the respective longitudinal edges of the cut-out sections by respective gaps.

As to still another aspect of the invention, the flexible channel having C-shaped cross-section configuration is made of a material having sufficient stiffness capable of retaining the C-shaped cross section along the length of the body when a hosiery item is disposed on the apparatus.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

DETAILED DESCRIPTION OF THE INVENTION

Figure 2:
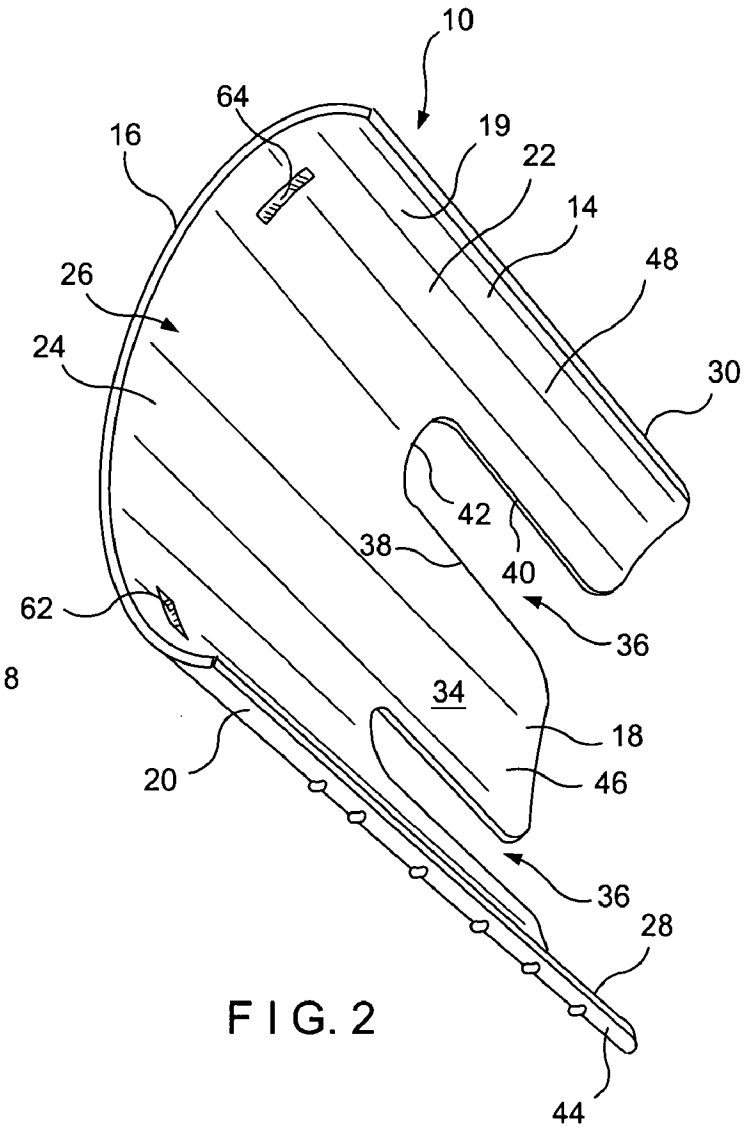
FIG. 2 is another perspective view thereof.
Figure 1:
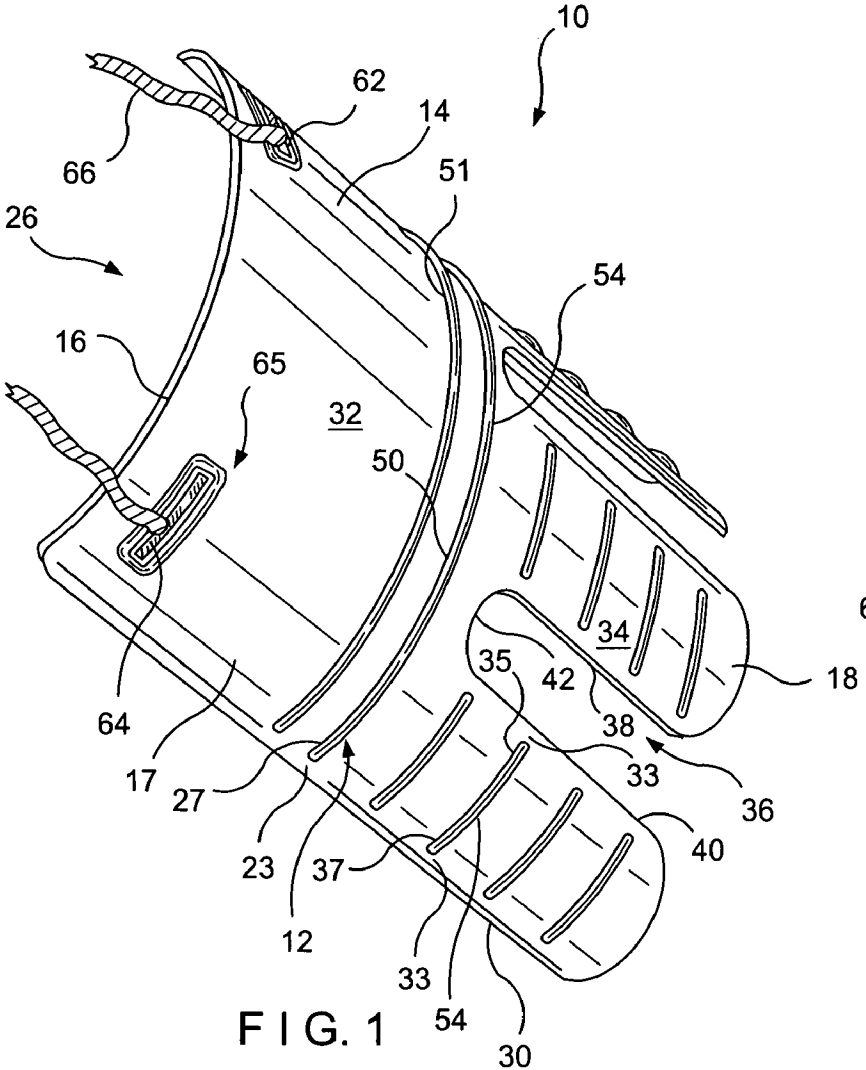
FIG. 1 is a perspective view of one embodiment of a hosiery donning aid having a frictional arrangement of the invention.
Figures 3, 4, 5:
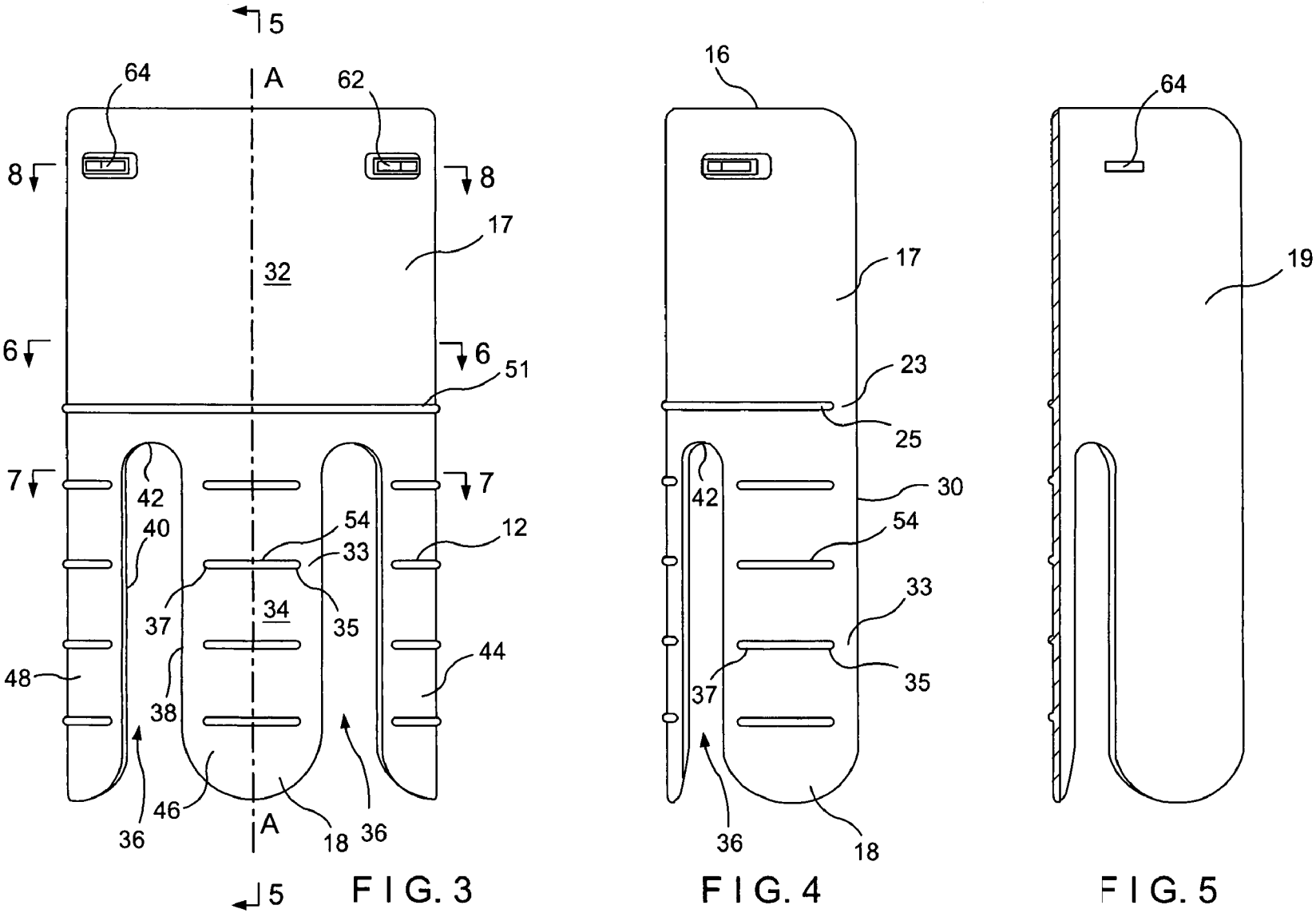
FIG. 3 is a front elevational view of the hosiery donning aid with the frictional arrangement according to a preferred embodiment of the invention.
FIG. 4 is a side elevational view thereof.
FIG. 5 is a sectional view according to section line 5—5 of FIG. 3.
Figure 7:
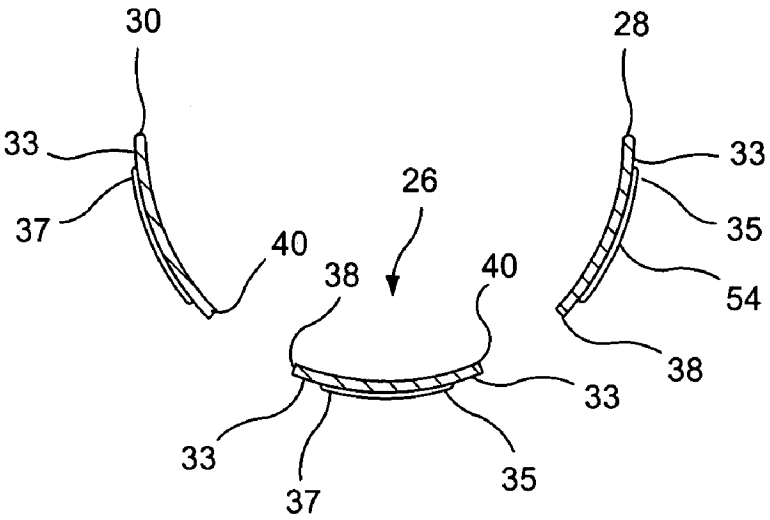
FIG. 7 is a section view according to section line 7—7 of FIG. 3.
Figure 6:
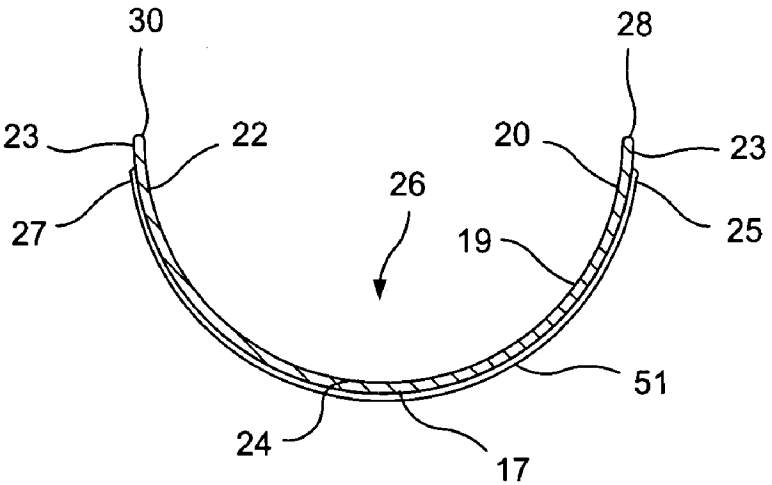
FIG. 6 is a sectional view according to section line 6—6 of FIG. 3.
Figure 8:
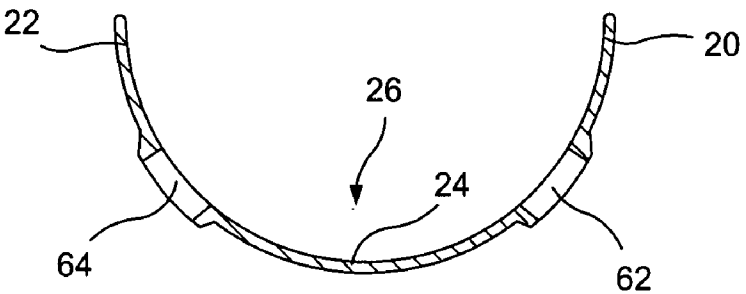
FIG. 8 is a section view according to section line 8—8 of FIG. 3.

Referring now to the drawings and in particular to FIG. 1–8, wherein one embodiment of a hosiery donning aid 10 having a frictional arrangement 12 of the invention is best illustrated. A body 14 of the donning aid having exterior 17 and interior 19 surfaces extends along a longitudinal axis A—A between a proximal or heel end 16 and a distal or toe end 18 thereof. The body 14 is defined by a pair of side panel portions 20, 22 contiguous with an arcuate base portion 24. The side panel portions and the base portion define the body having continuous C-shaped cross-sectional configuration. In this manner, the interior surface 19 of the body forms a continuous C-shaped receiving channel 26 having width and depth adapted to receive therein a foot of a wearer by whom a hosiery item will be donned. The inner surface 19 is preferably smooth, so as to facilitate sliding of the user's foot into and out of the donning aid. At a free end side panels terminates at a respective outer edges 28, 30, which are substantially straight, smooth and extend longitudinally along the axis A—A of the body 14. The proximal 16 and distal 18 ends extend the entire perimeter of the body around the C- channel from one outer edge to the other.

A proximal region 32 of the body which extends between the proximal end 16 toward the central area is substantially solid. The distal or toe region 34 of the body, extending from the distal end 18 toward the central area is formed having a plurality of cut-out sections or slots 36. Such arrangement increases the flexibility of the device, and facilitates insertion and removal of the donning aid 10 into and from the respective hosiery item. In the preferred embodiment of the invention, as illustrated in at least FIGS. 3–8, there are two slots 36 provided having preferably U-shaped configuration and extending substantially along the longitudinal axis A—A of the body. Each slot 36 is formed with two longitudinal edges 38, 40 spaced apart from each other and joined at their proximal ends by a connecting portion 42. In this manner, the distal region 34 of the hosiery donning aid is formed as a multi or three pronged structure, wherein prongs 44, 46, 48 are separated from each other by the respective cut-outs or slots 36.

Figure 10:
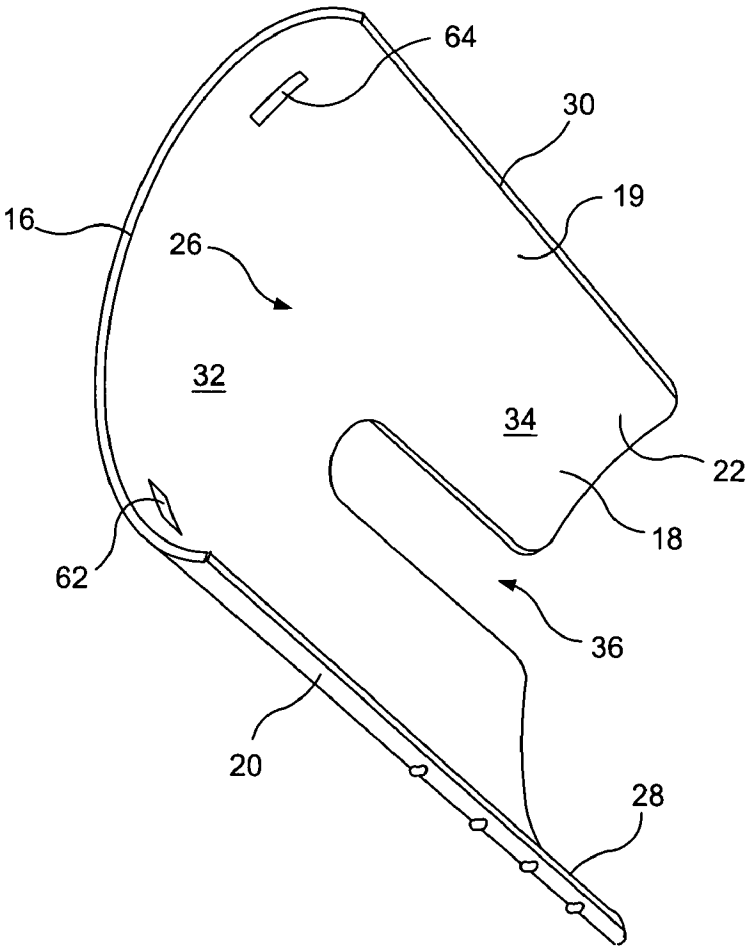
FIG. 10 is another perspective view thereof.
Figure 9:
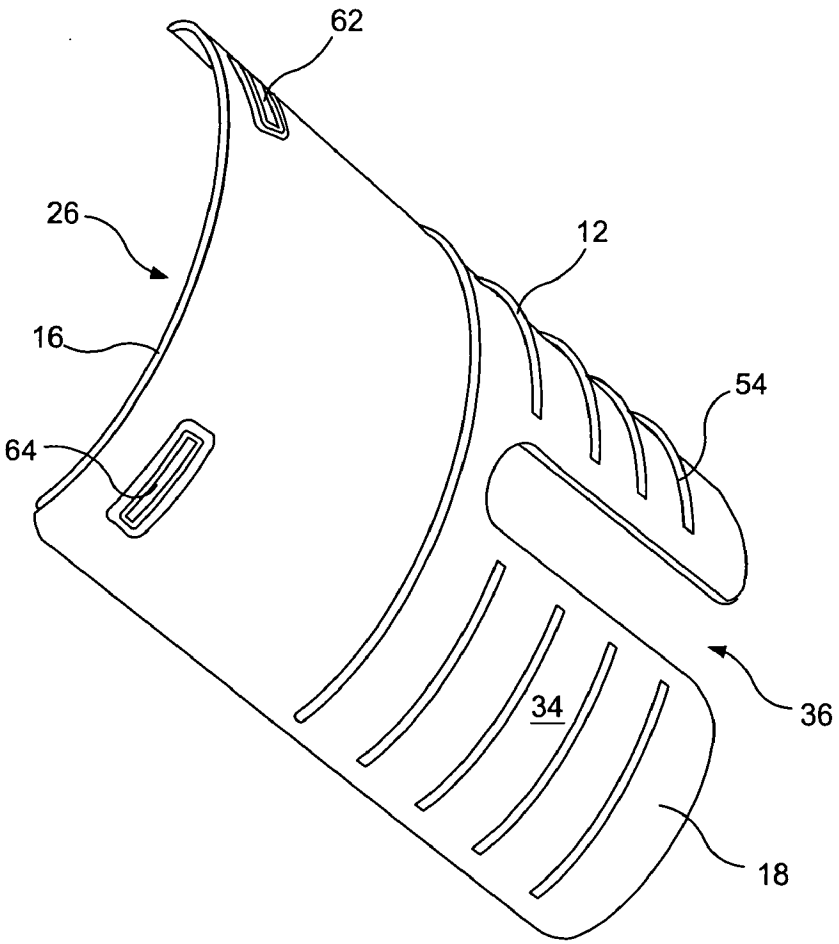
FIG. 9 is a perspective view of a hosiery donning aid having a frictional arrangement according to another embodiment of the invention.

Although the preferred embodiment of the invention is formed with two cut-outs or slots 36, any reasonable number of such slots is contemplated by the invention. For example, FIGS. 9 and 10 illustrate a hosiery donning aid formed with one cut-out section or slot 36 defining a two-prong structure at the distal region thereof. Furthermore, although the slots have been described having substantially U-shaped configuration, it should be also noted that any conceivable configuration of such slots is also within the scope of the invention. In this respect, the cut-outs or slots can be formed having substantially rectangular triangular elliptical and other configuration.

Figure 11:
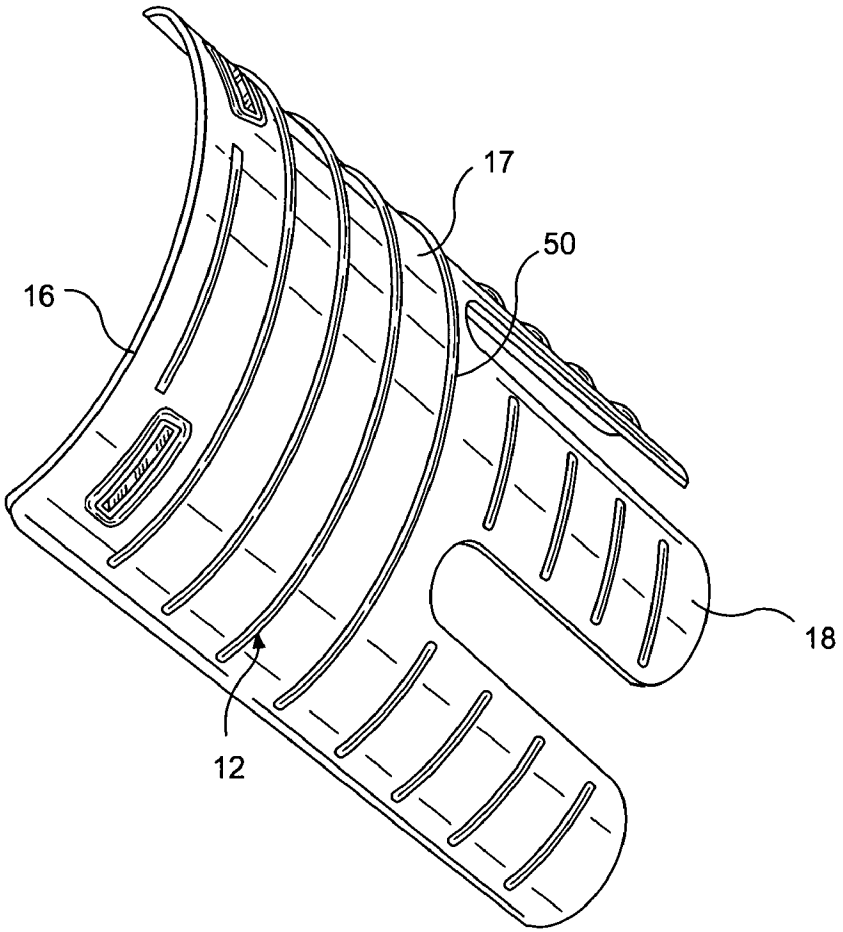
FIG. 11 is a perspective view of a further embodiment of the invention.

A frictional arrangement 12 compromising a multiplicity of spaced from each other frictional ribs 50 is provided on the exterior surface 17 of the body 14 so as to extend from about the central area toward the distal or toe end 18. In the embodiment illustrated in FIGS. 1–10, the proximal region of the body is free from the frictional ribs. However, it should be noted that the hosiery donning aid having a frictional arrangement comprising a multiplicity of spaced from each other frictional ribs and extending throughout the entire exterior surface 17 of the body is within the scope of the invention. As illustrated in FIG. 11 the frictional arrangement 12 consists of a plurality of ribs 50 extending from the heel or proximal end 16 to a distal or toe end thereof 18.

The exterior of the proximal region 32 can be smooth or formed with roughness so as to further enhance engagement with the hosiery item. In the preferred embodiment of the invention, the most proximal area of the frictional arrangement 12, which extends from the connecting portions 42 of the cut-outs or slots 36 toward the proximal end 16, consists of at least one continuous and uninterrupted frictional ribs 51 extending radially through a respective area of the exterior surface 17. The remaining part of the frictional arrangement 12 is disposed on the prongs 44, 46, 48 and consists of the frictional ribs which are interrupted by the slots 36. In this manner each such frictional rib is separated into a plurality of spaced from each other frictional rib segments 54. In order to prevent highly undesirable tearing of the hosiery items, it is essential to assure the smoothness of the edges of the hosiery donning aid engaging such items. In the invention this achieved in general by preventing the extension of the frictional ribs into the outer edges 28, 30 and longitudinal edges 38, 40. More specifically, as clearly illustrated in at least FIGS. 1, 3, 4 and 6, a gap 23 separates each end 25, 27 of the uninterrupted frictional ribs 51 from the respective outer edges 28, 30 of the body 14. Further more, the ends 35, 37 of each rib segment 54 are also spaced from the respective outer edges 28, 30 of the side panels and the longitudinal edges 38, 40 of the cut-outs or slots by respective gaps 33 (see FIGS. 1–4 and 7).

In the preferred embodiment the area of the substantially smooth proximal region 32 on the exterior surface 17 relates to the area occupied by the frictional arrangement 12 in 1:1.3 ratio, whereas the frictional arrangement is spaced about four inches from the respective proximal end 16, with the distance between two adjacent ribs being about one inch. The frictional ribs are preferably rounded on their cross-section. The height of the frictional ribs, measured at a line tangent their tops is about one-sixteenth of an inch. In the illustrated embodiment, the length of the C-shaped channel is approximately 8.75 inches, as measured along the longitudinal axis A—A from the proximal edge 16 to distal edge 18. The depth of the channel 26 is approximately 2.25 inches and about 4.5 inches wide as measured between the longitudinal edges 28, 30 in the direction substantially perpendicular to the longitudinal axis A—A.

In the working condition, when the hosiery donning aid is inserted into the respective hosiery item, the frictional ribs 50, 51 54 positioned on the exterior surface 17 of the body 14 engage an inner surface of a stocking. In this condition, the undesirable movement of the hosiery donning aid within the hosiery item, after it reaches its final position, is substantially minimized or prevented. This is specifically important for those individuals having physical disability including limited hands and fingers dexterity who are unable to manipulate the donning aid within the respective hosiery item.

Since the donning aid is frequently of limited utility to an individual, it is desirable that the device be of sufficiently low cost. In this manner, the donning aid may be thrown away when a patient no longer requires the device. In the preferred embodiment, the hosiery donning aid including the frictional arrangement is made of a polymeric material that is relatively inexpensive, durable and relatively easy adapted to accept a desired configuration. On the other hand, it should be recognized that a body made of any suitable material is within the scope of the invention. For example, the body can be made from plastics such as high density polyethylene, polypropylene, polystyrene, polyvinyl chloride and nylon and metals such as steel, aluminum, etc. The plastic material meets the low cost requirement and provides the necessary durability of the device.

Figure 12:
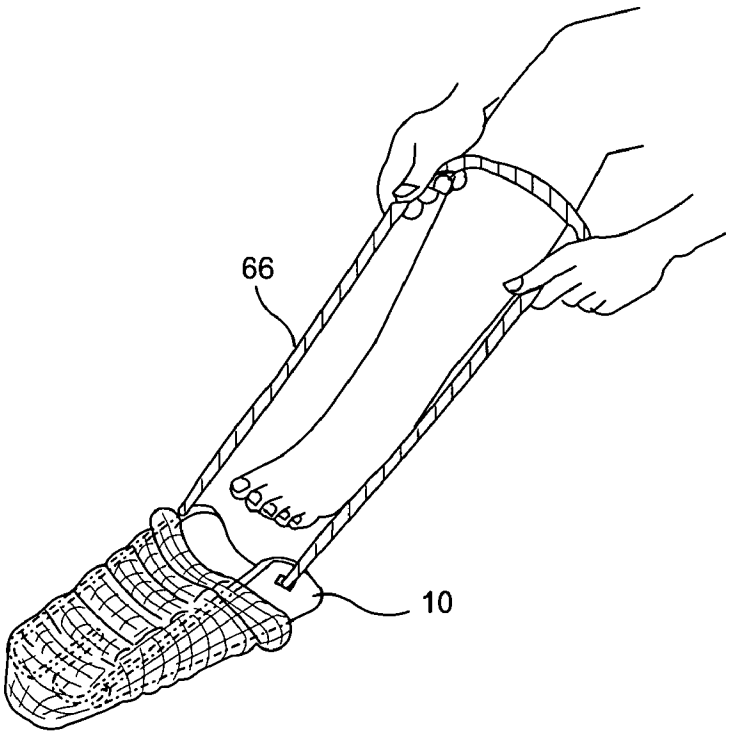
FIG. 12 is a schematic diagram illustrating use of the hosiery donning aid having the frictional arrangement of the invention.

The donning aid 10 can be operated in conjunction with a handle device, illustrated as a strap or straps 66 attached by attachment means 65. In the preferred embodiment of FIGS. 1–5, such attachment means 65 is in the form of openings 62, 64 provided at the proximal end 16. In use, it is essential for the aid to be properly positioned and retained within the hosiery item. In this manner it is recommended to have the toe end 18 of the aid to be positioned and retained at the toe portion of the hosiery item with the heel portion of the hosiery item being oriented along the longitudinal axis A—A of the device. Upon insertion of the donning aid, the frictional arrangement 12 having the plurality of frictional ribs 50 engaging the interior of the hosiery item is an important factor in retaining such required proper orientation. As it is clear from FIG. 12 the donning aid with the hosiery item positioned thereupon is situated near the foot and leg upon which the hosiery item is to be worn. The straps 66 can be disposed on either side of the leg, so as to be grasped by the wearer. The wearer should then slip the toe into the donning aid until the toe reaches the toe portion of the hosiery item adjacent to the distal end 18. The wearer then pulls on the straps 66 such that the donning aid slips over the foot and instep, upwardly over the calf. As the wearer pulls on the straps the donning aid slides along the calf. In this manner the hosiery item is placed comfortably on the wearer. The frictional arrangement 12 and engagement of the frictional ribs 50 with the interior of the hosiery item causes such item to be properly oriented and disposed over the leg of the user minimizing undesirable shifting.

It will be appreciated by those skilled in the art that changes could be made to the above described embodiments without departing from the broad inventive concept thereof. For example, the frictional ribs can have varying length, width and thickness. Moreover, the material and thickness of the body can vary depending on the particular usage.

What is claimed is:

1. A hosiery donning aid apparatus, comprising:

a body having interior and exterior surfaces and extending between proximal and distal ends thereof, said body being formed by a pair of spaced from each other side walls contiguous with an arcuate base portion so as to form an elongated receiving channel;

each said side wall terminating at a respective outer edge extending along a longitudinal axis of the body;

a frictional arrangement, comprising a multiplicity of spaced from each other frictional ribs extending outwardly from said exterior surface in such a manner that a substantial gap separates each end of each said frictional rib from at least said outer edges; and at least two cut-out portion formed within said body and extending inwardly within said body from said distal end thereof forming at least three prongs, each said cut-out portion is defined by a pair of spaced longitudinal edges joined by a connecting portion, wherein each said frictional rib disposed on an outer surface of said prongs is being separated into a plurality of frictional segments by the respective cut-out portions.

2. The apparatus of claim 1, wherein said elongated channel is formed having a substantially C-shaped cross-section so that, in use said interior surface of said C-shaped channel being adapted to guide a foot of a wearer, and said exterior surface including said frictional arrangement are being adapted to engage an inner surface of a hosiery item so as to enhance engagement there between.

3. The apparatus of claim 1, wherein said plurality of frictional segments is disposed at an outer surface of said at least three prongs, so as to be spaced from the respective outer edges of the side walls and the respective longitudinal edges of the cut-out sections by respective gaps.

4. The apparatus of claim 1, wherein said frictional ribs extend radialy along substantially full outer periphery of said body intermediate said proximal and distal ends.

5. The apparatus of claim 1, wherein said frictional ribs being formed with rounded edges, so that during the donning procedure the inner surface of a hosiery item slides over said ribs.

6. The apparatus of claim 2, wherein said body is made of a material having stiffness capable of retaining the C-shaped cross-section along its length when a hosiery item is fully disposed on the apparatus.

7. The apparatus of claim 1, wherein said frictional arrangement is spaced from said distal end by an area of roughness formed on the exterior surface of the body.

8. The apparatus of claim 1, wherein a most proximal area of the frictional arrangement extending from said connecting portions of the at least two cut-out portions toward the proximal end consists of at least two uninterrupted frictional rib extending through a substantial portion of the exterior surface.

9. The apparatus according to claim 1, wherein said frictional ribs are being transverse to a longitudinal axis of said body.

10. The apparatus according to claim 9, wherein projection of said frictional ribs on a flat surface being substantially perpendicular to a projection of the longitudinal axis on said flat surface.

11. The apparatus according to claim 10, wherein an outer periphery of said frictional ribs is formed having a curved configuration.

12. The apparatus according to claim 11, wherein said outer periphery of frictional ribs is formed having a semicircular configuration.

13. A hosiery donning aid apparatus, comprising:

a body having interior and exterior surfaces and extending between proximal and distal ends thereof, said body being formed by a pair of spaced from each other side walls contiguous with an arcuate base portion, said arcuate base so as to form an elongated receiving channel having substantially C-shaped cross-section;

each said side wall terminating at a respective outer edge extending longitudinally along a longitudinal axis of the body;

a frictional arrangement, comprising a multiplicity of spaced from each other frictional ribs extending outwardly from said exterior surface in such a manner that a substantial gap separates each end of each said frictional rib from at least said outer edges; and and at least two cut-out portion formed within said body and extending inwardly within said body from said distal end thereof forming at least three prongs, each said cut-out portion is defined by a pair of spaced longitudinal edges joined by a connecting portion, wherein each said frictional rib disposed on an outer surface of said prongs is being separated into a plurality of frictional segments by the respective cut-out portions.

14. The apparatus of claim 13, wherein said plurality of frictional segments is disposed at an exterior surface of said prongs, so as to be spaced from the respective outer edges of the side walls and the respective longitudinal edges of the cut-out portions by respective gaps.

15. The apparatus of claim 13, wherein in use said interior surface of said C-shaped channel being adapted to guide a foot of a wearer, and said exterior surface including said frictional arrangement are being adapted to engage an interior surface of a hosiery item so as to enhance engagement therebetween.

16. A hosiery donning aid apparatus, comprising:

a body having interior and exterior surfaces and extending between proximal and distal ends thereof, said body being formed by a pair of spaced from each other side walls contiguous with an arcuate base portion so as to form an elongated receiving channel;

each said side wall terminating at a respective outer edge extending along a longitudinal axis of the body, so that the continuous convex outer surface extends between said outer edges;

a frictional arrangement comprising of multiplicity of spaced from each other frictional ribs extending outwardly from said continuous convex outer surface; and at least one cut-out portion extends inwardly within said body from said distal end thereof forming at least two prongs each having a continuous convex outer surface, wherein each said frictional rib is being separated by said at least one cut-out portion into a plurality of frictional segments disposed on the outer surfaces of the respective prongs.

* * * * *